United States Patent [19]

Tsubota et al.

[11] Patent Number: 4,477,927

[45] Date of Patent: Oct. 23, 1984

[54] BASEBALL GLOVE

[75] Inventors: Nobuyoshi Tsubota, Osaka; Ichio Miyake, Kawanishi, both of Japan

[73] Assignee: Mizuno Corporation, Osaka, Japan

[21] Appl. No.: 464,666

[22] Filed: Feb. 7, 1983

[30] Foreign Application Priority Data

Feb. 8, 1982 [JP] Japan ..... 57-16916[U]

[51] Int. Cl.[3] ..... A41D 13/10

[52] U.S. Cl. ..... 2/19

[58] Field of Search ..... 2/19, 163

[56] References Cited

U.S. PATENT DOCUMENTS

| | | | |
|---|---|---|---|
| 1,045,231 | 11/1912 | Whitley | 2/19 |
| 2,231,204 | 2/1941 | Turner | 2/19 |
| 2,725,561 | 12/1955 | Blepp | 2/19 |
| 3,528,107 | 9/1970 | Rosenbaum | 2/19 |

*Primary Examiner*—Louis Rimrodt

*Attorney, Agent, or Firm*—Fleit, Jacobson, Cohn & Price

[57] ABSTRACT

A rear seam of each finger sheath of a baseball glove is formed by securing a reinforcing strip onto two of three sheath members along their adjacent edges to provide an elasticity of the finger sheath and facilitate its bending toward the palm of the glove.

6 Claims, 5 Drawing Figures

BASEBALL GLOVE

TECHNICAL FIELD

This invention relates to baseball gloves having elastic finger sheathes which make it easier for baseball players to catch balls with their gloves.

BACKGROUND OF THE INVENTION

Conventional baseball gloves which have been employed for many years, comprise finger sheathes each formed by preparing three members of leather, bending inwardly the edges of the adjacent members on the lateral and rear sides of the finger sheathes, interposing leather straps between the inwardly bent edges of the members and stitching the bent edges and the straps together to form seams of the finger sheathes, and having lining sheathes of leather inserted into the finger sheathes, as shown in section in FIG. 5 of the accompanying drawings. With this arrangement, each of the seams of the finger sheathes includes inward protrusions defined by the inwardly bent edges of the members stitched together with the strap of leather therebetween, and the inward protrusions of the rear seam of the finger sheath function as a keel which is an obstacle to bend the sheath in a direction toward the palm of the glove. This results in a failure in catching the balls with the glove. Furthermore, the bending of the fingers brings the protrusions of the rear seams of the finger sheathes into indirect contact with the back of the fingers so that the player will have discomfort contact feelings. Repeatedly bending movement of the sheathes in the direction of the palm of the glove causes loads to impose on the rear seams of the sheathes, thereby tearing the leather and stitching threads.

A main object of the present invention is to provide a baseball glove having its finger sheathes which are free of the inward protrusions at the rear seams of the sheathes to avoid the above mentioned disadvantages.

Another object of the invention is to provide a baseball glove having elastic finger sheathes which make it easier for players to catch balls, and provide improved durability of the glove.

These objects of the invention can be achieved by providing a baseball glove comprising finger sheathes, each formed from face and rear members of leather, the face member being bent inwardly of the finger sheath at the edges thereof, the rear members being bent inwardly of the finger sheath at one edge thereof adjacent the first face member, the inwardly bent edges of the face and rear members being stitched together with straps of leather interposed therebetween to form lateral seams of the sheath, and reinforcing strip secured onto the other rear members adjacent their other edges.

BRIEF DESCRIPTION OF THE DRAWINGS

Other objects and advantages of the present invention will best be understood by reference to the following description taken in connection with the accompanying drawings in which.

DESCRIPTION OF PREFERRED EMBODIMENTS

Figure 1:
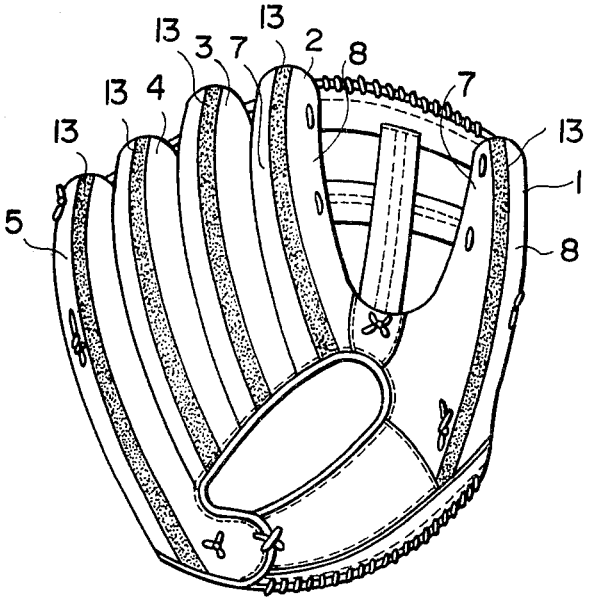
FIG. 1 is a rear perspective view of one preferred embodiment of the glove of the invention.
Figure 2:
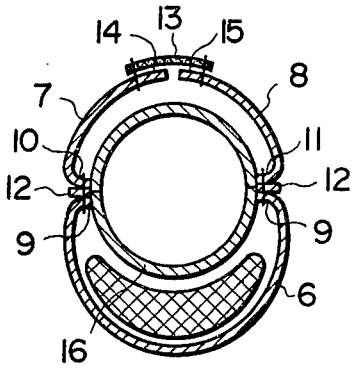
FIG. 2 is a cross-sectional view of one of the finger sheathes of the glove illustrated in FIG. 1.

Referring to FIGS. 1 and 2 of the drawings, a baseball glove of the present invention is shown having a glove body A and finger sheathes 1, 2, 3, 4 and 5 each formed from three face and rear members 6, 7 and 8 of leather. The face member 6 has the edges 9 bent inwardly of the finger sheath and the rear members 7 and 8 are bent inwardly of the finger sheath at one edges 10 and 11 thereof adjacent the face member 6. The adjacent inwardly bent edges 9 and 10 and 9 and 11 of the face and rear members 6, 7 and 8 are stitched together with straps 12 of leather interposed therebetween to form side seams of the finger sheath. The reinforcing strip 13 is made of reinforced leather impregnated with synthetic resin and secured onto the rear members 7 and 8 along their other adjacent edges 14 and 15 by stitching the strip 13 to the rear members to provide an elasticity of the finger sheath.

Figure 3:
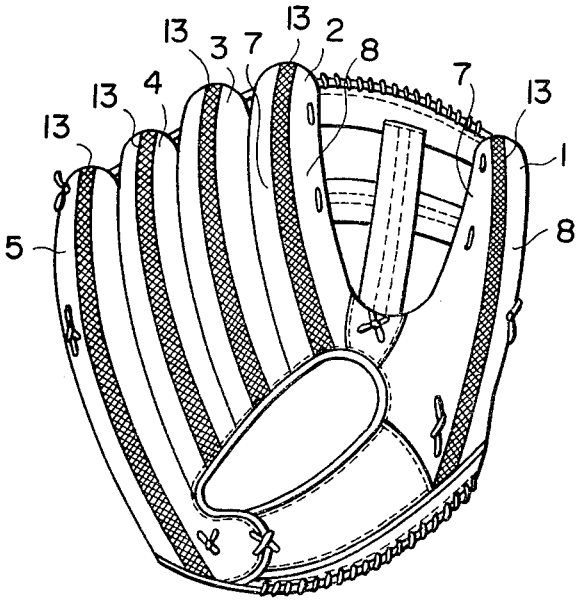
FIG. 3 is a view similar to FIG. 1, but showing another preferred embodiment of the baseball glove of the invention.
Figure 4:
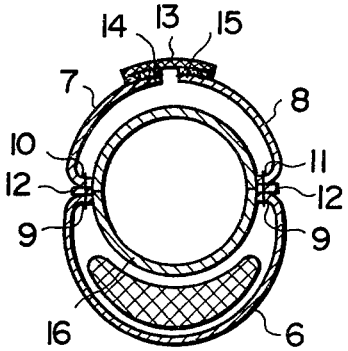
FIG. 4 is a view similar to FIG. 2, but showing one of the finger sheathes of the glove illustrated FIG. 3.
Figure 5:
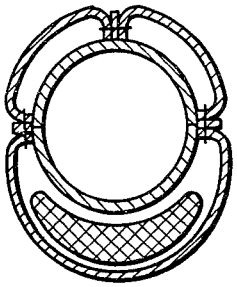
FIG. 5 (PRIOR ART)
FIG. 5 is a cross-sectional view of one of the finger sheathes of a conventional baseball glove.

A baseball glove of the invention illustrated in FIGS. 3 and 4 is similar to that illustrated in FIGS. 1 and 2 except that the reinforcing strip 13 is of fiber reinforced plastic and secured onto the rear members 7 and 8 along their adjacent edges 14 and 15 by means of adhesive. The reinforcing strip 13 may be of a thin sheet of metal. In the embodiment shown in FIGS. 1 through 4, the reinforcing strip 13 extends over a whole length of each of the finger sheathes, but may extend from the tip to the crotch of the finger sheathes. As can be seen in FIGS. 2 and 4, each of the embodiment of the invention includes a lining sheath 16 of leather inserted into each of the finger sheathes in a conventional manner.

As can be seen in FIGS. 2 and 4, the finger sheathes are free of any protrusions at the rear seams thereof as in the conventional glove and the adjacent edges of the rear members of each of the finger sheathes are of the flat form which facilitates bending movement of the finger sheathes in a direction toward the palm of the glove. The reinforcing strips which may be of reinforced leather, fiber reinforced plastic or a thin sheet of metal serves to prevent each of the finger sheathes from bending rearwardly and deforming. This ensures that the players can catch the balls with their gloves without any failure.

We claim:

1. An improved baseball glove comprising:

a plurality of finger sheaths, each of said sheaths including a face member with first and second edges, two rear members each having first and second edges, means for joining said first edge of said face member to said first edge of one of said rear members, means for joining said second edge of said face member to said first edge of said other rear member the improvement comprising means for joining said second edges of said rear members to each other, said means for joining said second edges of said rear members to each other comprises an reinforcing strip overlapping onto said rear members, the second edges of said rear members being spaced from to each other and said elastic reinforcing strip being secured to the rear members along said second edges.

2. A baseball glove as claimed in claim 1 wherein said reinforcing strip is secured onto said rear members along their adjacent edges by stitching.

3. A baseball glove as claimed in claim 1 wherein said reinforcing strip is bonded to said rear members with adhesive.

4. A baseball glove as claimed in claim 1, wherein such reinforcing strip is made of reinforced leather impregnated with synthetic resin.

5. A baseball glove as claimed in claim 1, wherein said reinforcing strip is made of fiber reinforced plastic.

6. A baseball glove as claimed in claim 1 wherein said reinforcing strip is made of a thin sheet of metal.

* * * * *